United States Patent [19]

Bourlet et al.

[11] 4,420,899

[45] Dec. 20, 1983

[54] AUTOMATIC PISTOL WITH COMBINED MAGAZINE CONTROL SAFETY AND MAGAZINE EJECTION MECHANISM

[75] Inventors: Maurice V. Bourlet, Liege; Jean-Pierre H. Storder, Namur, both of Belgium

[73] Assignee: Fabrique Nationale Herstal, Herstal, Belgium

[21] Appl. No.: 298,574

[22] Filed: Sep. 2, 1981

[30] Foreign Application Priority Data

Oct. 16, 1980 [BE] Belgium ..... 2/58809

[51] Int. Cl.[3] ..... F41C 17/08

[52] U.S. Cl. ..... 42/70 A; 42/7

[58] Field of Search ..... 42/7, 70 A

[56] References Cited

U.S. PATENT DOCUMENTS

| | | | |
|---|---|---|---|
| 1,359,746 | 11/1920 | Reising | 42/7 |
| 1,389,944 | 9/1921 | Garrison | 42/7 |
| 1,719,384 | 7/1929 | Tansley | 42/70 A |
| 2,372,519 | 3/1945 | Roper | 42/7 |

*Primary Examiner*—Charles T. Jordan

*Attorney, Agent, or Firm*—Bacon & Thomas

[57] ABSTRACT

A combined function mechanism for an automatic pistol including a magazine and a magazine housing, which mechanism interrupts the kinematic chain between the trigger and the hammer when the magazine is not fully engaged within its housing, thereby preventing operation of the hammer by the trigger, the mechanism also serving to eject the magazine from the housing when the magazine locking/unlocking device is actuated.

4 Claims, 1 Drawing Figure

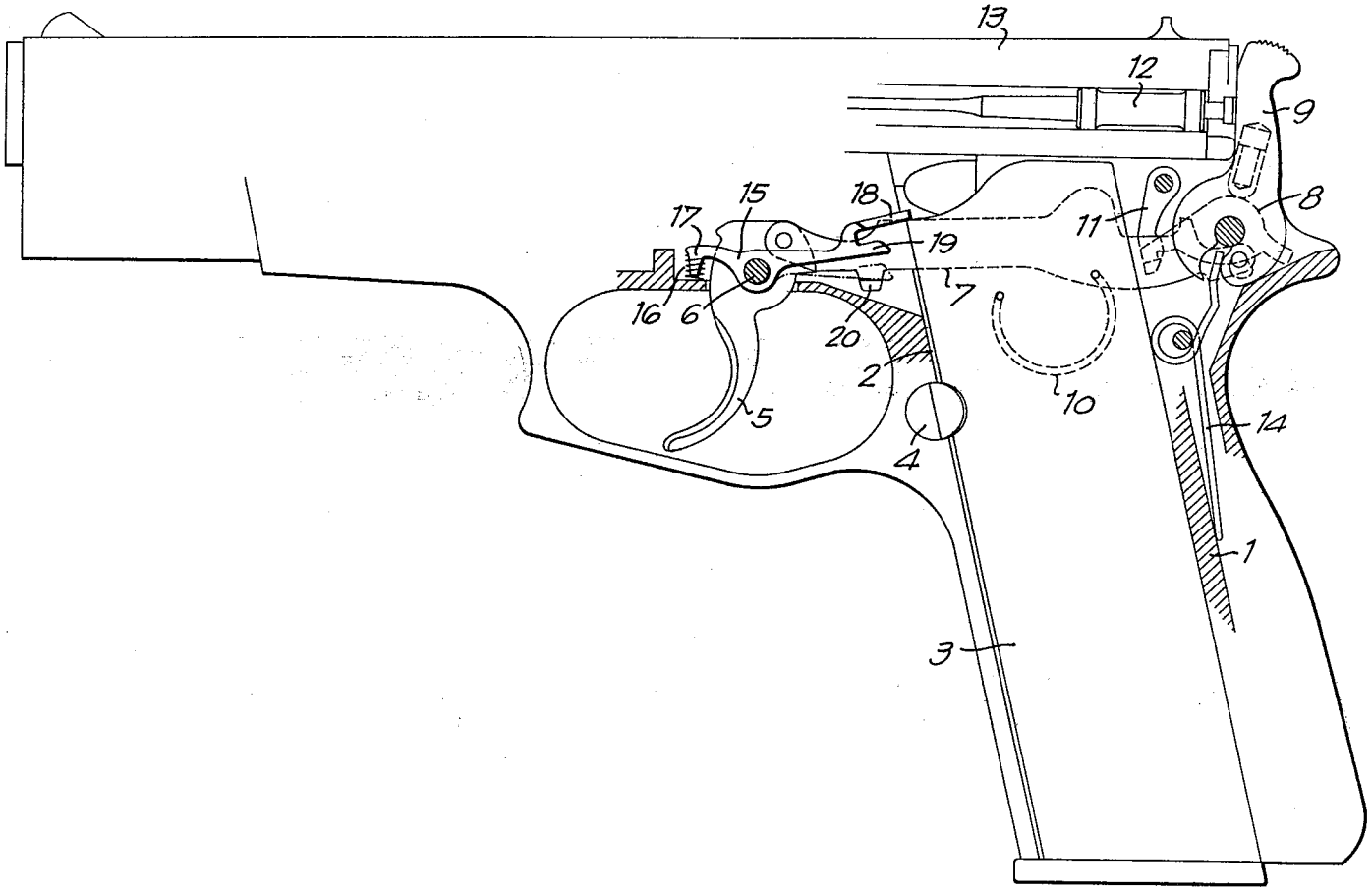
1
2
3
4
5
6
7
8
9
10
11
12
13
14
15
16
17
18
19
20

AUTOMATIC PISTOL WITH COMBINED MAGAZINE CONTROL SAFETY AND MAGAZINE EJECTION MECHANISM

The present invention relates to an automatic pistol having a body with a housing for a magazine, a trigger pivoted on a pivot pin of said body, a hammer, a kinematical chain linking said trigger and said hammer through a plurality of elements, and a magazine controlled safety mechanism which includes a magazine controlled element which when said magazine is removed from said housing operates on an element of said kinematical chain so as to interrupt the latter and thus prevent the trigger from operating the hammer.

Such an automatic pistol is already known from the Reising U.S. Pat. No. 1,359,746 and the Roper U.S. Pat. No. 2,372,519.

An object of the present invention is to provide an automatic pistol of the above type but provided with means to eject the magazine from its housing when the means provided to lock and unlock the magazine in its housing is engaged in the unlocking position.

The automatic pistol according to the present invention includes a body with a housing for a magazine, means for locking said magazine in said housing and for unlocking it therefrom, a trigger pivoted on a pivot pin of said body, a hammer, a kinematical chain linking said trigger and said hammer through a plurality of elements, and a combined magazine controlled safety and magazine ejection mechanism including a finger on one of said elements, a spring bearing on said body and a magazine controlled lever pivoted on said pivot pin between a first end and a fork-shaped second end provided with first and second prongs, said first end being engaged by said spring so as to urge said first prong into the inside of said housing and said second prong into the direction of said finger, all in such a way that when said magazine is locked in said housing by said locking and unlocking means, said magazine maintains said lever in a rest position wherein said spring is compressed and said kinematical chain is established, whereas when said magazine is unlocked from said housing by said locking and unlocking means, said spring releases and pivots said lever in a direction wherein said first prong ejects said magazine from said housing and said second prong operates on said finger of said one element so as to interrupt said kinematical chain.

Thus the spring and magazine conrolled lever intervenes in the establishment of the kinematical chain and the compression of the spring as well as in the interruption of this chain and the ejection of the magazine.

The above and other characteristics and features of the present invention will be described hereinafter with respect to an embodiment of an automatic pistol according to the invention and by making reference to the drawing showing such a pistol.

The automatic pistol shown has a body 1 with a housing 2 for a magazine 3 which may be locked in this housing 2 or unlocked therefrom by a locking/unlocking device 4. A trigger 5 is pivoted on a pivot pin 6 of the body 1 and is connected to one end of a trigger bar 7, the other end of which is engaged into a disconnector 8 combined with a hammer 9. Thus, a kinematical chain is formed between the trigger 5 and the hammer 9. The pistol further includes a trigger spring 10 acting on the trigger bar 7, a sear 11, a firing pin 12 in a breech 13 and a spring 14 associated with the hammer 9.

A combined magazine controlled safety and magazine ejection mechanism includes a lever 15 pivoted on the pivot pin 6 of the trigger 5 between its first end 17 and its fork-shaped second end having a first prong 18 and a second prong 19. The mechanism further includes a spring 16 bearing on the body 1 and acting upon the first end 17 of the lever 15 and a finger 20 on the trigger bar 7.

When the magazine 3 is locked in the housing 2 by the locking/unlocking device 4 it maintains the lever 15 in the position shown wherein the spring 16 is compressed and the kinematical chain between the trigger 5 and the hammer 9 is established as the trigger bar 7 is in its operative position.

On the contrary, when the magazine 3 is unlocked from the housing 2 by the device 4 the compressed spring 16 releases and pivots the lever 15 in a clockwise direction. As a consequence the prong 18 ejects the magazine 3 out of the housing 2, while the prong 19 when coming into contact with the finger 20 on the trigger rod 7 pushes the latter downwardly so as to interrupt the kinematical chain between the trigger 5 and the hammer 9, thus preventing trigger 5 from operating hammer 9.

What I claim is:

1. In an automatic pistol including a body, a housing in the body for accommodating a magazine, means for locking the magazine in the housing, a pivot pin, a trigger mounted on the pivot pin, a hammer, linking means including a plurality of elements defining an interruptible kinematic chain between the trigger and the hammer, and wherein the improvement comprises a lever mounted on the body, the lever having a first end and a second end, the second end including first and second prongs, biasing means for urging the first prong against a magazine and forcing it to eject, an interrupt means carried by one of the elements defining the kinematic chain and being engageable by the second prong for interrupting the kinematic chain when a magazine is not locked in the housing, thereby preventing operation of the hammer by the trigger.

2. The automatic pistol of claim 1 wherein the biasing means includes a spring disposed between the first end of the lever and the body of the pistol.

3. The automatic pistol of claim 1 wherein the interrupt means includes a finger-shaped member.

4. The automatic pistol of claim 1 wherein the lever is pivotally mounted on the pivot pin.

* * * * *